US011653137B2

(12) United States Patent
Udesen et al.

(10) Patent No.: US 11,653,137 B2
(45) Date of Patent: May 16, 2023

(54) METHOD AT AN ELECTRONIC DEVICE INVOLVING A HEARING DEVICE

(71) Applicant: GN Hearing A/S, Ballerup (DK)

(72) Inventors: Jesper Udesen, Måløv (DK); Jonas Raun Hansen, Roskilde (DK)

(73) Assignee: GN HEARING A/S, Ballerup (DK)

( * ) Notice: Subject to any disclaimer, the term of this patent is extended or adjusted under 35 U.S.C. 154(b) by 5 days.

(21) Appl. No.: 17/369,821

(22) Filed: Jul. 7, 2021

(65) Prior Publication Data

US 2021/0337301 A1 Oct. 28, 2021

(30) Foreign Application Priority Data

Jul. 17, 2020 (DK) ..... PA 202070493

(51) Int. Cl.
*H04R 25/00* (2006.01)
*H04R 1/10* (2006.01)
*H04R 29/00* (2006.01)

(52) U.S. Cl.
CPC ..... *H04R 1/1041* (2013.01); *H04R 29/001* (2013.01); *H04R 2430/01* (2013.01)

(58) Field of Classification Search
CPC ..... H04R 29/00; H04R 25/30
See application file for complete search history.

(56) References Cited

U.S. PATENT DOCUMENTS 10,299,047 B2 5/2019 Meyer et al.
2002/0040254 A1 4/2002 Neoh
2010/0254538 A1 10/2010 Latzel
2011/0019846 A1 1/2011 Anderson
2014/0029775 A1 1/2014 Anderson
2018/0084328 A1 3/2018 Ernst et al.
2018/0296137 A1 10/2018 Anderson et al.

OTHER PUBLICATIONS

Foreign examination report dated Jan. 14, 2021 for Danish patent application No. PA 2020 70493.
Foreign Intention to Grant for Danish Patent Appln. No. PA 2020 70493 dated Feb. 15, 2022.
Extended European Search Report for EP Patent Appln. No. 21183518.6 dated Dec. 14, 2021.

*Primary Examiner* — Ping Lee

(74) *Attorney, Agent, or Firm* — Vista IP Law Group, LLP

(57) ABSTRACT

A method performed by an electronic device, includes: enabling first communication to a pair of headphones having first and second acoustic output transducers; enabling second communication to a first hearing device that has a first gain stage; communicating a band-limited portion of a first audio test signal via a second gain stage and via the first acoustic output transducer to the first hearing device while the first hearing device is in a first ear canal of a first ear, and communicating a band-limited portion of a second audio test signal via the second acoustic output transducer to an eardrum of a second ear; and determining a first gain value based on a gain value of the first gain stage and/or a gain value of the second gain stage, the first gain value being associated with the user's perception of equal loudness at both the first and second ears.

28 Claims, 9 Drawing Sheets

METHOD AT AN ELECTRONIC DEVICE INVOLVING A HEARING DEVICE

RELATED APPLICATION DATA

This application claims priority to, and the benefit of, Danish Patent Application No. PA 202070493 filed on Jul. 17, 2020. The entire disclosure of the above application is expressly incorporated by reference herein.

FIELD AND BACKGROUND

A "hearing device" may be of a type with or without compensation for a user's hearing loss.

In some aspects the hearing device is a hearing instrument, e.g. denoted a hearing aid, including compensation for a user's hearing loss. The hearing instrument may be fitted in accordance with a so-called open fitting or a so-called closed fitting as it is known in the art.

In some aspects the hearing device is an ear-phone configured as a headset and for listening to audio signals, e.g. music, and including one or more microphones for receiving sounds from the surroundings, preferably, the user's speech.

The hearing device may include spatial filtering techniques such as beamforming and/or filtering in a time-frequency domain. The hearing device may also include active noise-cancellation.

Generally, a user may wear one hearing device in one ear or one in each ear. A hearing device is configured for full or partial insertion in an ear canal and includes an acoustic input transducer, e.g. a microphone or an array of microphones, typically capturing acoustic waves from the surroundings of the user and coupled to an acoustic output transducer, e.g. a miniature loudspeaker, arranged close to and/or facing a the user's eardrum, when the hearing device is inserted in the ear canal.

It has been observed that, since the hearing device is configured for full or partial insertion in an ear canal, and since the ear canal is thus fully or partially blocked or occupied, also acoustically, the wearer perceives sound from the surroundings as not sounding natural. This is sometimes explained by the passive dampening of acoustic waves propagation in the ear canal by the hearing device or rather its housing and any members thereof.

It is observed that the advent of hearing devices with a so-called hear-though mode, wherein the passive dampening is deliberately compensated for by amplification, is not sufficient. A hear-though mode lets the user hear acoustic sounds from the surroundings despite of, e.g. significant, passive dampening in the ear canal while wearing the hearing devices. A hear-through mode can normally be engaged or disengaged, e.g. by the user and works, when engaged, while listening to, e.g. music, from an audio source or while using the hearing device as headset for telephone or conference calls and also when worn without being engaged in a call or without listening to an audio source.

In practice, this has led to a lack of acoustic fidelity and inconveniences for users.

Also, "headphones", "a pair of headphones" or a headphone are known in the art and include one or two ear-cups each accommodating an acoustic output transducer, e.g. a small loudspeaker, for reproducing an electric audio signal as an acoustic signal. The ear-cups sometimes include a cushion or other type of soft member, which makes wearing headphones more comfortable. The ear-cup rests on the wearer's ear or at the head while covering the ear. Typically, headphones include a headband for keeping the headphone (s) in place on the wearer's head. Headphones may be of a closed type, wherein only a small amount of sound leaks out from the space formed between the ear cup and the wearer's ear and/or head. Headphones may alternatively be of an open type, wherein a larger amount of sound leaks out from the ear-cup.

Throughout this application, the terms 'band' and 'frequency band' are used interchangeably.

SUMMARY

It is observed that conventional hearing devices, configured for being at least partially inserted in a user's one or both ear(s) degrades at least the fidelity of acoustic sounds from the surroundings, in particular when a hear-through mode is engaged.

The claimed method obtains frequency band specific gain values for a so-called flat insertion gain filter. The flat insertion gain filter improves fidelity in the reproduction of sounds from the surrounds at the user's ear drum while wearing the hearing device at least partially inserted in the user's one or both ear(s). In some aspects of the method, it may be assumed that the user intends to wear a hearing device in one ear and to not wear a hearing device in the other ear. In some aspects of the method, it may be assumed that the user has a symmetric hearing at the left ear and the right ear.

There is provided a method comprising: at an electronic device with, one or more communication elements;

enabling first communication, via the one or more communication elements, to a pair of headphones including a first acoustic output transducer and a second acoustic output transducer;

enabling second communication, via the one or more communication elements, to a first hearing device; wherein the first hearing device is configured for insertion in an ear canal and includes an acoustic input transducer coupled to an acoustic output transducer via a first gain stage;

for each period of time of multiple periods of time; wherein each period of time is associated with a band of multiple bands:

communicating a band-limited portion of a first audio test signal via a second gain stage and via the first acoustic output transducer to a user's first eardrum and communicating a band-limited portion of a second audio test signal via the second acoustic output transducer to a user's other eardrum;

controlling a gain value of the first gain stage and/or a gain value of the second gain stage and, in response to the user's first input, determining a first gain value specifically for the band, based on the gain value of the first gain stage and/or the gain value of the second gain stage; wherein the first gain value is associated with the user's perception of equal loudness at both ears; and storing the first gain value for the band.

The method is performed by the electronic device and involves a user's first input. The method may be implemented in an application program, e.g. known as an app, running on the electronic device. The method is based on the user wearing the headphones and wearing the first hearing device in the one ear canal, while no hearing device is inserted in the other ear canal. The method enables obtaining one or more first gain values for a first flat insertion gain filter. The first flat insertion gain filter enables improved fidelity e.g. in connection with a hear-through mode of the first hearing device. Rather than obtaining values enabling compensation for the user's potential hearing loss caused by impaired auditory sensitivity in the physiological auditory system, the method obtains values enabling compensation for the hearing device fully or partially occupying the ear canal and thereby altering the user's hearing compared to not wearing a hearing device fully or partially occupying the ear canal.

The first gain value is based on the gain value of the first gain stage and/or the gain value of the second gain stage. In some aspects, the gain value of the second gain stage is fixed, the gain value of the first gain stage is controlled, and the first gain value is determined to be equal to the gain value of the first gain stage. The gain value of the first gain stage is thereby a controlled gain value. In other aspects, the gain value of the second gain stage is controlled, the gain value of the first gain stage is fixed, and the first gain value is determined to be equal to the gain value of the second gain stage. The gain value of the second gain stage is thereby a controlled gain value. The first gain value is based on the controlled gain value. In some aspects, both the gain value of the first gain stage and the gain value of the second gain stage are controlled. The second gain stage may be accommodated at the headphones and/or at the electronic device e.g. in software.

The method may be performed as a session or part of a session involving the user. The session may be a second session, which is followed by a third session. In the third session, the method is based on the user wearing headphones and wearing a second hearing device in the other ear canal, while no hearing device is inserted in the one ear canal. The method, in the third session, enables obtaining one or more second gain values for a second flat insertion gain filter. The second flat insertion gain filter enables improved fidelity e.g. in connection with a hear-through mode of the second hearing device. The first hearing device may be configured for a left ear, while the second hearing device is configured for a right ear, or vice versa.

The second session and the third session may be preceded by a first session, wherein the method is based on the user wearing the headphones and not wearing a hearing device in either the one ear or in the other ear. The first session may obtain gain values for compensating for a user's different hearing at the one ear and the other ear. However, it is possible to forgo using the first session e.g. based on a user's rejection of the first session.

At least while in a hear-through mode, the first and/or second hearing device is configured to communicate an acoustic signal captured by the acoustic input transducer to the acoustic output transducer via the flat insertion gain filter. This communication is in addition to acoustic waves propagating from the surroundings to the eardrum via the ear canal, which is partially occupied by the hearing device or rather a housing and any members, e.g. flexible or non-flexible, thereof. In particular, in accordance with the method, the wearer of the hearing device may perceive the acoustic sounds from the surroundings, sounding more natural. The acoustic sounds from the surroundings may sound more natural both in terms of amplitude and in terms of absence of or at least reduced colorization of the sounds.

In some examples the first audio test signal and the second audio test signal are monaural. When reference is made to a test signal, it is a reference to both signals, monaurally, or as different signals. The test signal is distributed across an audible spectrum or a portion thereof. The test signal may be distributed between a lower frequency of about 20 Hz to an upper frequency in the range about 6 kHz to 20 kHz, e.g. at 8 kHz or 12 kHz. In some examples, the first audio test signal and the second audio test signal are different, and not monaural, but have a substantially equal power spectrum.

The test signal is communicated at different periods of times and at multiple bands. The multiple bands may include bands at bass, midrange and treble. Finer or coarser selection of bands may be used. In some aspects, bands are selected in accordance with a non-linear scale e.g. the Bark scale. The bands may be defined by a range of frequencies and/or by a centre frequency. Bands may be enumerated and identified accordingly.

As an example, the multiple bands may include three bands e.g. enumerated bass, midrange and treble, respectively. A bass portion of the audio test signal is communicated to the user's ear drums during a first period of time and the first gain value is stored for the bass band e.g. as a first element of an array. A midrange portion of the audio test signal is communicated to the user's ear drums during a second period of time and the first gain value is stored for the midrange band e.g. as a second element of the array. A treble portion of the audio test signal is communicated to the user's ear drums during a third period of time and the first gain value is stored for the treble band e.g. as a third element of the array. The first gain values for the different bands may be communicated to the hearing device for the flat insertion gain filter e.g. element by element or in another way. For example, the first gain value is determined, based on the user's first input and the user's perception of equal loudness at both ears to be 0 dB for the bass band, +3 dB for the midrange and +6 dB for the treble. In another example, the first gain values are [+3 dB, 0 dB, 3 dB, 9 dB] for respective bands e.g. with a centre frequency of [60 Hz, 300 Hz, 1000 Hz; 8kHz]. In some examples, the first gain value is determined for one band, e.g. a treble band, whereas one or more bands at lower frequencies has/have a fixed gain. The first gain values may be obtained by controlling the gain value of the first gain stage and/or a gain value of the second gain stage. These examples also apply, mutatis mutandis, for a second gain value described further below.

Preferably, the periods of time do not overlap. In some aspects the bands do not overlap or overlap partially. In some aspects, one or more bands fully overlap(s) another band. The duration of the periods may be selected automatically, or the duration of the periods may be based on a user's input e.g. by a user giving input to proceed with the session.

The first audio test signal and the second audio test signal should enable the user to perceive whether loudness is stronger at one ear (e.g. balance is to the left) or the other ear (e.g. balance is to the right) or whether loudness is equal at both ears (e.g. balance is at the centre). The audio test signal should have at least periods with fairly static loudness, rather than a dynamic loudness to enable the user time to perceive whether loudness is stronger at one ear or the other ear or whether loudness is equal at both ears. The audio test signal may have fade-in periods and fade-out periods. The test signal may be a noise signal, e.g. band limited white or coloured noise. The test signal may be recorded or composed to include natural sounds e.g. sounds resembling water streams or waves or winds in trees and the like. Natural sounds may be perceived to be more pleasant than noise signals. The test signal may include a single tone or multiple tones. The test signal may be composed from any combinations of the above.

In some aspects, the band-limited portion of the first audio test signal and the band-limited portion of the second audio test signal is communicated at the same time or at different, e.g. immediately subsequent, periods of time. Listening to the test signal at both ears at the same time may be perceived as enabling a more easy judgement of balance or, alternatively, listening, to the test signal at one ear at a time may be perceived as enabling a more easy judgement of balance. In some examples, the method enables the user to select either listening at both ears at the same time or listening at both ears, one ear at a time. In some aspects, the method includes a first sub-session enabling listening at both ears at the same time and a second sub-session enabling listening at both ears, one ear at a time.

The first gain stage may be included in a flat insertion gain filter. In some aspects, the flat insertion gain filter is accommodated in the hearing device. This enables the more natural reproduction of acoustic sounds without requiring a connection to the electronic device while the hearing device is in a hear-through mode. In other aspects, the flat insertion gain filter is accommodated in the electronic device, wherein the communication from the acoustic input transducer to the acoustic output transducer takes place, e.g. by wireless communication, via the electronic device.

In some aspects, the enabling of the first communication and/or the enabling of the second communication includes establishing a wireless communication from the electronic device. The wireless communication may be in accordance with a Bluetooth protocol or another wireless protocol e.g. a proprietary wireless protocol. The first communication, to the pair of headphones includes e.g. streaming of the test signal from the electronic device to the headphones or establishing a streaming connection from a signal source to the headphones. The signal source may be at a remote server or at the headphones.

The second communication may include information for accessing an application programmable interface of the hearing device. The application programmable interface may enable setting and/or reading of a gain value for the first gain stage or a flat insertion gain filter. The gain value of the first gain stage may be set and/or read via a so-called gain handle.

In some aspects, the band-limited portions of the test signal are band-limited to match band filters of the flat insertion gain filter(s). Thus, whereas the test signal is synthesized or sampled, the flat insertion gain filters are supposed to filter any signal captured by the acoustic input transducer of the hearing device. A perfect match between the band-limited portions of the test signal and the flat insertion gain filters is not necessary, but a certain correspondence is needed to reduce colorization of the sounds in a hear-through mode.

The flat insertion gain filter can be used in one or both of the first hearing device and the second hearing device. The flat insertion gain filter may be coupled between the acoustic input transducer coupled to an acoustic output transducer. A flat insertion gain filter can be provided based on the one or more first gain values. The first gain stage may be a gain stage of a flat insertion gain filter.

In some aspects, the electronic device comprises a display and one more or more input elements. The display may be a light source, such as one or more LEDs or a graphic display comprising a matrix of pixels. The input elements may comprise physical buttons and/or touch-sensitive elements arranged to sense touch on the display. In some aspects, the electronic device is a personal computer. In some examples the electronic device is a smart-phone or a smart-watch or a tablet computer. In some examples, the electronic device is an electronic auxiliary device configured to control a hearing device. In some aspects, the communication elements include one or more wireless communication elements e.g. for Bluetooth communication.

In some aspects, the band-limited portions of the audio test signal are separated in time. The band-limited portions of the audio test signal may be separated by a time period determined by a user's response.

In some embodiments the electronic device and/or the first hearing device is/are operatively coupled to a second hearing device; and wherein the second hearing device is configured for insertion in an ear canal and includes an acoustic input transducer coupled to an acoustic output transducer via a third gain stage; comprising:

for each period of time of multiple periods of time; wherein each period of time is associated with a band of multiple bands:

communicating a band-limited portion of a third audio test signal via a fourth gain stage and via the second acoustic output transducer to a user's second eardrum and communicating a band-limited portion of a fourth audio test signal via the second acoustic output transducer to the user's second eardrum;

controlling a gain value of the third gain stage and/or a gain value of the fourth gain stage and, in response to the user's second input, determining a second gain value for the band, based on the gain value of the third gain stage and/or the gain value of the fourth gain stage; wherein the second gain value is associated with the user's perception of equal loudness at both ears;

storing the second gain value for the band

This part of the method may be performed as a part of a third session following the second session. Both the second session and the third session involve the user.

In the third session, the method is also based on the user wearing headphones but wearing a second hearing device in the other ear canal, while no hearing device is inserted in the one ear canal. Thus, the user should remove the first hearing device from the one ear and insert the second hearing device in the other ear. The user may do this between the second session and the third session. The user may need to (re-) move the headphones while inserting and removing the hearing devices.

The method, in the third session, enables obtaining one or more second gain values for a second flat insertion gain filter. The second flat insertion gain filter enables improved fidelity e.g. in connection with a hear-through mode of the second hearing device. The first hearing device may be configured for a left ear, while the second hearing device is configured for a right ear, or vice versa.

The user wearing both hearing devices may, as a result, perceive that sounds from the surroundings sound more natural or at least will less colorization of the sound.

In some aspects, the first hearing device is operatively coupled to a second hearing device. Thereby, the electronic device can communicate gain values for the second hearing device via the first hearing device. The first hearing device and the second hearing device may preferably be coupled via a wireless connection.

In some aspects, the method comprises enabling a third communication, via the one or more communication elements, to the second hearing device.

In some embodiments the method comprises:

for each period of time of multiple periods of time; wherein each period of time is associated with a band of multiple bands:

(1) controlling a gain value of the second gain stage and/or a gain value of the first gain stage and, in response to the user's third input, determining a third gain value specifically for the band, based on the gain value of the first gain stage and/or the gain value of the second gain stage; wherein the third gain value is associated with the user's perception of equal loudness at both ears;

(2) storing the third gain value for the band; and obtaining the first gain value and/or the second gain value based on communicating the first audio signal and/or the second audio signal via equalization; wherein the equalization is configured to change gain at a band in accordance with a gain value based on the third gain value for the band.

This part of the method may be performed as a part of at least a first session preceding the second session and preceding the third session, if any. The first session involves the user and generates third gain values based on which the second session and the third session can be performed. In particular, the first session enables compensation for a difference in hearing at the user's left ear and right ear. This in turn improves the gain values for the flat insertion gain filter(s), especially when the user has different hearing on one ear compared to the other ear. In particular, but not limited thereto, when performing the method at the first session with a user who has different hearing on one ear compared to the other ear, the first flat insertion gain filter(s) enable improved fidelity e.g. in connection with a hear-through mode of the first hearing device.

In some aspects, the first session is based on controlling gain in a left side and keeping the gain in the right side fixed or controlling gain in the right side and keeping the gain in the left side fixed.

In the first session, the method is also based on the user wearing headphones but without wearing a hearing device inserted in any of the ear canals.

The third gain values may also, or alternatively, be used for playback of music or speech signals through the headphones. The third gain values may then be stored in the electronic device.

In some embodiments the method comprises:

communicating a first message at a time before the user's first input, wherein the first message indicates that the headphones are to be worn while: the first hearing device is to be inserted in the user's first ear; and the second hearing device is to be kept out of the other ear; and receiving the user's first input at a time following a first time of the first message.

Thereby the user is given instructions of how to interact with the electronic device for performing the technical task of obtaining gain values for a flat insertion gain filter. The first time of the first message may be a time at which the first message commences or at a time when the first message is complete.

In some aspects, the first message is communicated and/or the user's first input is received during the second session. The first message may be communicated by displaying an image and/or video and/or one or more graphical elements and/or text elements. The first message may additionally or alternatively be communicated by outputting. e.g. via the headphones and/or a loudspeaker integrated in the electronic device, spoken passages of text.

In some aspects, the method involves displaying a first user interface screen with one or more affordances on a display of the electronic device for receiving the user's input, e.g. the user's first input, via a touch-sensitive display. In some aspects the method involves displaying a slider affordance for the user to adjust the gain values or a balance. In some aspects the method involves displaying a button affordance for receiving a user's first input. In some aspects, the user's first input is received at the slider affordance e.g. in response to the lapse of a timer, which is started when the slider is moved a first time.

Additionally, or alternatively, the electronic device may receive the user's input via input elements, e.g. via touch-sensitive input elements, of the headphones.

The user's input may be a 'tap' gesture and/or a 'slide' gesture and/or a 'swipe' gesture. In some aspects, the user's input is a spoken audio input, which is received via a microphone of the electronic device or via a microphone of the headphones or a microphone of the hearing device.

In some embodiments the method comprises:

communicating a second message at a time after the user's first input and before the user's second input, wherein the second message indicates that the headphones are to be worn while the first hearing device is to be kept out of the user's first ear; and the second hearing device is to be inserted in the user's other ear; and receiving the user's second input at a time following a first time of the second message.

In some aspects, the second message is communicated and/or the user's second input is received during the third session.

The user's second input is preferably received as described in connection with the user's first input. In particular, in some aspects, the method involves displaying a second user interface screen with one or more affordances on a display of the electronic device for receiving the user's input, e.g. the user's first input, via a touch-sensitive display.

In some embodiments the method comprises:

communicating a third message, wherein the third message indicates that the headphones are to be worn while the first hearing device and the second hearing device are to be kept out of the user's ears; and receiving the user's third input at a time following a first time of the third message.

In some aspects, the third message is communicated and/or the user's third input is received during the first session.

The user's third input is preferably received as described in connection with the user's first input and/or the user's second input. In particular, in some aspects, the method involves displaying a third user interface screen with one or more affordances on a display of the electronic device for receiving the user's input, e.g. the user's third input, via a touch-sensitive display.

Preferably, the third message is communicated to the user and user's third input is received before the first message is communicated to the user.

In some embodiments the first hearing device comprises a first set of gain filters coupled between the acoustic input transducer and the acoustic output transducer; wherein the first set of gain filters is configured to change gain at a band in accordance with a gain value based on the first gain value, $G_L$, for the band; and/or the second hearing device comprises a second set of gain filters coupled between the acoustic input transducer and the acoustic output transducer; wherein the second set of gain filters is configured to change gain at a band in accordance with a gain value based on the second gain value specifically for the band.

Thereby one or both of the first hearing device and the second hearing device is configured with filters enabling improved fidelity e.g. in connection with a hear-through mode of the hearing devices. The filters may be used for frequency-gain equalization and/or for flat insertion gain filters enabling improved fidelity.

In some embodiments the method comprises:

communicating, to the first hearing device, a first set of gain values, each based on the first gain value for the band; and/or communicating, to the second hearing device, a second set of gain values, each based on the second gain value for the band.

Thereby one or both of the first hearing device and the second hearing device is configured with a flat insertion gain filter enabling improved fidelity e.g. in connection with a hear-through mode of the hearing devices. The flat insertion gain filters are based on the gain values obtained using the method at the electronic device, in interaction with the user giving input, for associating gain values with the user's perception of equal loudness at both ears.

A hear-through mode may be enabled at the first hearing device and/or the second hearing device at times when the hearing device is playing music or communicating a voice signal. The hear-through mode may be enabled at any time when the hearing device is active.

In some embodiments, at each period of time of the multiple periods of time, any of the audio signals is/are band-limited to the band associated with the period of time.

Preferably, the periods of time do not overlap. In some aspects the bands do not overlap or overlap partially. In some aspects, one or more bands fully overlap(s) another band. The duration of the periods may be selected automatically, or the duration of the periods may be based on a user's input e.g. by a user giving input to proceed with the session.

As an example, the multiple bands may include three bands e.g. enumerated bass, midrange and treble, respectively. A bass portion of the audio test signal is communicated to the user's ear drums during a first period of time and the first gain value is stored for the bass band e.g. as a first element of an array. A midrange portion of the audio test signal is communicated to the user's ear drums during a second period of time and the first gain value is stored for the midrange band e.g. as a second element of the array. A treble portion of the audio test signal is communicated to the user's ear drums during a third period of time and the first gain value is stored for the treble band e.g. as a third element of the array.

As an example, one or more of the audio test signals is limited to bands at lower frequencies during first periods of time and limited to bands at higher frequencies during subsequent periods of time e.g. by shifting the band-limited portion upwards or downwards in frequency during the course of subsequent periods of time. The user may then perceive the audio test signal as gradually increasing or gradually decreasing in frequency. The band-limited portions may also be in a randomized order.

The audio test signal(s) may be synthesized by band-specific generators or be generated as signal distributed across multiple bands, wherein the audio test signal is subsequently filtered by a band-pass filter for the respective band.

The multiple periods of time may have a predetermined maximum duration; wherein the method stores a first gain value and/or a second gain value based on a default gain value which may be a current gain value of a gain stage.

In some embodiments the method comprises: displaying, on the display, a first affordance for receiving a user's balance input and for the controlling of the gain value of the first gain stage and/or the gain value of the second gain stage; and in response to receiving the user's balance input, adjusting the gain value of the first gain stage and/or the gain value of the second gain stage.

In this way the gain is adjusted at one side via the balance input. The gain of the other side may be held fixed at least while receiving the user's input is enabled.

The first affordance may be a slider affordance or a rotatable-wheel affordance. The first affordance may comprise buttons for stepwise tapping higher or lower values. The affordance provides values for controlling the gain values e.g. based on a scale conversion. In some aspects, the first gain value is determined based on a value obtained from the first affordance.

In some embodiments the method comprises: communicating the first audio signal at different gain levels at different periods of time; and displaying, on the display, a second affordance for receiving a user's accept of perceived equal loudness; and in response to receiving the user's accept, storing the first gain value and/or the second gain value and/or the third gain value.

Thereby, the user is not required to move a slider or other control input. Rather the user can tap the second affordance at a first location to accept that loudness is perceived to be equal at both ears or, by tapping at a second location, to reject that loudness is perceived to be equal at both ears. After communicating at least a portion of the first audio signal at different balance settings at different periods of time, the users accept may be given.

Same or substantially same portions of the audio test signal may be communicated once during a session or in a repeated or randomized manner during a session.

The audio test signal is communicated at different balance settings and at different bands at different periods of time. Inputs received via the second affordance are registered at a point in time associated with a balance setting at the point in time and a band of the band-limited audio test signal at the point in time.

In some embodiments the method comprises:

determining whether to deploy the first gain value and/or the second gain value, and in accordance with a determination to deploy the first gain value and/or the second gain value:

deploying a set of the first gain value at or for a set of gain filters at the first hearing device; and/or deploying a set of the second gain value at or for a set of gain filters at the second hearing device.

The determination, whether to deploy the first gain value, may be based on a determination that a user fulfilment criterion is satisfied. The user fulfilment criterion may include that a user's input is received for all or a predetermined set or number of the multiple bands and/or that a user's input is received for all or a predetermined set or number of the multiple periods of time. Thus, it may be determined that the user has fully completed or partly completed one or more sessions and that the gain values obtained can be deployed at or for the hearing device to improve fidelity e.g. in a hear-through mode.

In some embodiments the first gain value and/or the second gain value for the bands are confined to a predefined increment and/or decrement and/or to predefined gain levels.

Thereby, a trade-off between fidelity and time required to complete one or more of the sessions is provided. The predefined increment and/or decrement and/or to predefined gain levels may enable the user to select a gain level more quickly, which is perceived as providing equal loudness at both ears.

Examples of predefined increments and/or decrements may be +2 dB and −2 dB or +3 dB and −3 dB. Other finer or coarser increments and/or decrements may be used. Examples of predefined gain levels may be [0 dB, +3 dB, +6 dB, +9 dB]. In some examples a more progressive scale may be used. The gain levels may be limited to predefined maximum values and/or predefined minimum values.

In some embodiments the user's first input, for the user's first ear, is received concurrently with the user wearing the first hearing device in the first ear and not wearing a second hearing device in the second ear.

In some embodiments, the first hearing device and the second hearing device are included in a pair of hearing devices and are configured for wearing in or at a user's first ear and in or at a user's second ear, respectively.

In some embodiments the user's second input, for the user's second ear, is received concurrently with the user wearing the second hearing device in the second ear and not wearing the first hearing device in the first ear.

In some embodiments the user's third input, is received concurrently with the user not wearing any of the first and second hearing devices inserted in any of the user's ears. Thereby it is possible to correct the balance of the user's (asymmetric) hearing between his/hers two ears.

In some embodiments the method comprises:

controlling the gain value of the first gain stage (122) and/or the gain value of the second gain stage (137) in response to the user's first input during a second session; and controlling the gain value of the third gain stage (127) and/or a gain value of the fourth gain stage (138) in response to the user's second input during a third session;

wherein the second session and the third session do not overlap in time.

Thus, the user gives his/her input for one ear at the time, during different sessions. Since one of the ears (one of the ear canals) is not occupied by a hearing device, the 'free' ear, can serve as a reference for the user assessing when equal loudness is perceived (in response to his input).

In some embodiments the method comprises: determining the third gain value in response to the user's third input during a first session; wherein the first session precedes the second session and the third session.

Thereby it is possible to obtain compensation (balance) of the user's (asymmetric) hearing between his/hers ears before determining the first gain value and the second gain value.

In some embodiments the method comprises forgoing performing a fitting procedure to determine compensation for the user's possible hearing loss. Thus, the method does not obtain values enabling compensation for the user's potential hearing loss.

There is also provided an electronic device, comprising:

one or more communication elements;

a display;

one or more input elements;

at least one processor coupled to the one or more communication elements; the display; the one or more input elements; and a memory storing at least one program, wherein the at least one program is configured to be executed by the one or more processors, the at least one program including instructions for performing the method.

In some aspects, the electronic device is a smart-phone or a smart-watch, a tablet computer, or another type of personal computer.

In some aspects, the electronic device is an electronic auxiliary device configured to control a hearing device. In some aspects, the communication elements include one or more wireless communication elements e.g. for Bluetooth communication.

In some aspects, the electronic device is included in a pair of headphones.

There is also provided a computer readable storage medium storing at least one program, the at least one program comprising instructions, which, when executed by the at least one processor of an electronic device with one or more communication elements; a display; one or more input elements; and at least one processor, enables the electronic device to perform the method.

The computer readable storage medium may be a non-transitory computer-readable medium e.g. in the form of RAM or ROM memory. The computer-readable storage medium may be accommodated at the electronic device or at a server computer.

The term 'processor' may include a combination of one or more hardware elements. In this respect, a processor may be configured to run a software program or software components thereof. One or more of the hardware elements may be programmable or non-programmable.

BRIEF DESCRIPTION OF THE FIGURES

A more detailed description follows below with reference to the drawing, in which.

DETAILED DESCRIPTION

Figure 1A:
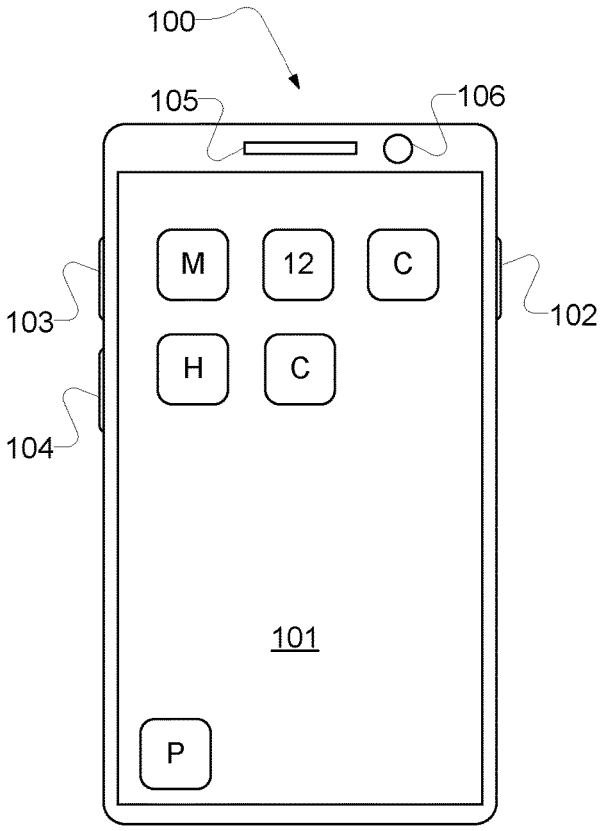
FIG. 1*a* shows an electronic device.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Assume that the hearing device has a microphone at the entrance of the ear canal and a miniature speaker (receiver) inside the ear canal pointing towards the eardrum. Furthermore, assume that the hearing device does not block the ear canal completely such that some sound can pass around the device without being amplified.

Flat insertion gain refers to an equalized or substantially flat amplitude transfer function.

Flat insertion gain $G_{flat}$ is obtained if the following expression is satisfied:

$$H_{closed}G_{flat} + H_{dir} = H_{open} \rightarrow G_{flat} = \frac{H_{open} - H_{dir}}{H_{closed}} \quad (1)$$

Wherein:

$H_{closed}$ is the transfer function from a far field speaker to the microphone multiplied by the transfer function from the receiver to the ear drum of the ear canal blocked by the device.

$G_{flat}$ is the frequency dependent gain in the device.

$H_{open}$ is the transfer function from the far field speaker to the eardrum of the unblocked ear.

$H_{dir}$ is the transfer function from the far field speaker to the eardrum of the blocked ear where the sound has not been amplified by the device (the direct path around the device or through a vent).

Note that equation 1 does not depend on the direction to the speaker as long as the microphone is placed at the entrance to the ear canal and the bandwidth of the sound is below about 12 kHz.

Assume now that we want to find a simple way of measuring the gain $G_{flat}$ in the listening devices on both ears such that flat insertion gain is obtained. The proposed method is based on the following sessions:

First Session

The user places a pair of headphones on his head (they do not need to be flat or calibrated in any way). The headphones are playing monaural, band limited noise with centre frequency $f_0$ (alternatively this could also be a pure tone signal with centre frequency $f_0$) and the user can adjust the gain $G_{hp}^{Right}$ in the right ear headphone to match the perceived loudness of his left ear.

The user will now adjust the gain $G_{hp}^{Right}$ in the right ear headphone such that the perceived loudness on both his ears are equal. That is:

$$H_{open}^{Left}A_{left} = H_{open}^{Right}G_{hp}^{Right}A_{right} \quad (2)$$

where $A_{left}$ and $A_{right}$ are the users hearing loss on each ear (note it can be asymmetric). The centre frequency $f_0$ of the bandlimited noise is thereafter changed to a new frequency and the procedure is repeated until all frequencies of interest are covered.

Second Session

Now the user places the left ear device in his left ear and put on the headphones. Again the headphones are playing monaural, band limited noise with centre frequency $f_0$ where the gain in the right ear headphone is set to $G_{hp}^{Right}$ and the user adjusts the gain $G_L$ in the left ear device such that the perceived loudness on both ears are equal. That is:

$$(H_{closed}^{Left}G_L + H_{dir}^{Left})A_{Left} = H_{open}^{Right}G_{hp}^{Right}A_{right} \quad (3)$$

Again, the procedure is repeated for all frequencies of interest.

Third Session

Finally, the user removes the left ear device and puts the right ear device in his right ear. Again, the headphones are playing monaural, band limited noise with center frequency $f_0$ and the gain in the right ear headphone is set to $G_{hp}^{Right}$. The user adjust the gain $G_R$ in the right ear device such that the perceived loudness on both ears are equal. That is:

$$H_{open}^{Left}A_{left} = G_{hp}^{Right}(H_{closed}^{Right}G_R + H_{dir}^{Right})A_{right} \quad (4)$$

Again, the procedure is repeated for all frequencies of interest.

Deriving Flat Insertion Gain

The right hand side of equation 2 and 3 are equal so we have:

$$(H_{closed}^{Left}G_L + H_{dir}^{Left})A_{Left} = H_{open}^{Left}A_{left} \quad (5)$$

which gives:

$$G_L = \frac{H_{open}^{Left} - H_{dir}^{Left}}{H_{closed}^{Left}} \quad (6)$$

and from equation 1 it follows that $$G_L = G_{flat}^{Left} \quad (7)$$

which is the flat insertion gain for the left ear.

The flat insertion gain filter for the right ear is found by observing that the left hand side of equation 2 and equation 4 are equal. This gives:

$$H_{open}^{Right}G_{hp}^{Right}A_{right} = G_{hp}^{Right}(H_{closed}^{Right}G_R + H_{dir}^{Right})A_{right} \quad (8)$$

$$G_R = \frac{H_{open}^{Right} - H_{dir}^{Right}}{H_{closed}^{Right}} \quad (9)$$

Substituting this expression into equation 1 directly gives:

$$G_R = G_{flat}^{Right} \quad (10)$$

which is the flat insertion gain filter for the right ear.

We have now shown that the gain settings $G_L$ and $G_R$ we measured are equal to the flat insertion gain settings we need to use in the devices to get flat insertion gain.

The centre frequencies of the bandlimited noise played over the headphones should cover the range in which flat insertion gain is desired. A natural choice is to use the frequencies defined by the Bark scale and let the corresponding noise signals match the width of the auditory filters.

FIG. 1*a* shows an electronic device. The electronic device 100 includes a touch-sensitive display 101, physical input buttons 102, 103 and 104, a camera lens 106 for a built-in camera (not shown) and a loudspeaker opening 105. The electronic device 100 displays a set of icons and/or affordances designated 'M', '12', 'C', 'H', 'C' and 'P'. An affordance, as known in the art of graphical user interfaces, has a graphical icon and properties that help a user understand that they can interact with it, and the type of interaction that may be involved. For instance, the affordance 'C' may be tapped to activate an application, e.g. an app, that performs the method described herein.

Figure 1B:
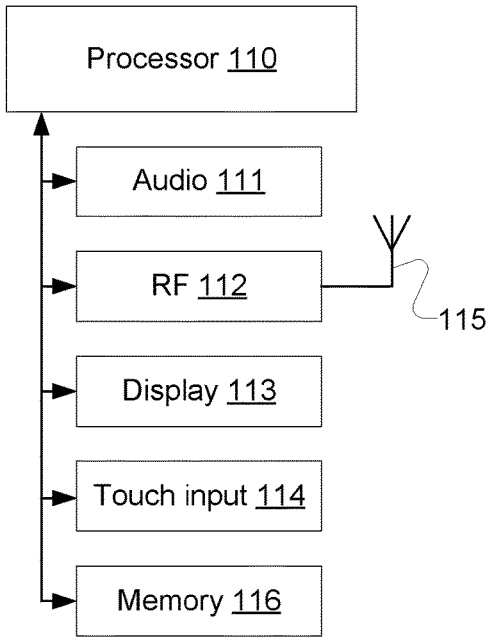
FIG. 1*b* shows hardware elements of the electronic device.
Figure 1C:
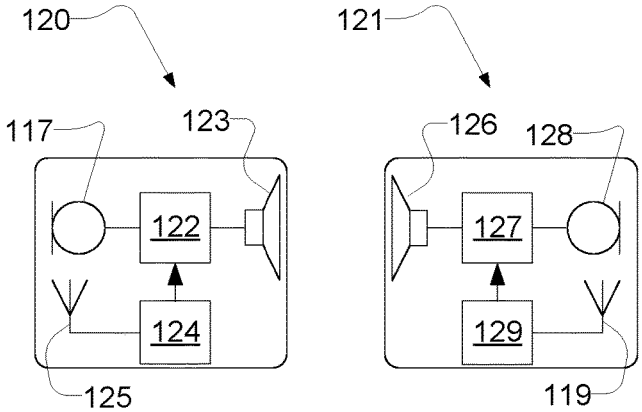
FIG. 1*c* shows a block diagram of a pair of hearing devices.
Figure 1D:
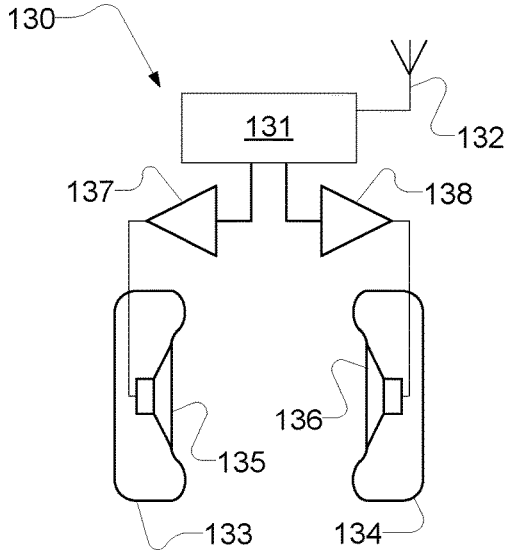
FIG. 1*d* shows a block diagram of a pair of headphones.

FIG. 1*b* shows hardware elements of the electronic device; FIG. 1*c* shows a block diagram of a pair of hearing devices; and FIG. 1*d* shows a block diagram of a pair of headphones. The hardware elements comprise a processor 110 that may include a combination of one or more hardware elements. In this respect, the processor may be configured to run one or more a software programs or software components thereof including the application that can be activated via the affordance 'C'. The processor 110 is coupled to an audio circuit 111, a radio frequency circuit 112, including one or more antennas 115, a display 113, which may be display 101, a touch input circuit 114 and a memory 115.

FIG. 1*c* shows a block diagram of a pair of hearing devices. The hearing devices 120 and 121 may be configured as hearing instruments to compensate for a hearing loss or be configured as a headset or ear-phones without compensating for a hearing loss. The hearing device 120 may be configured for insertion in an e.g. left ear canal and the hearing device 121 may be configured for insertion in an e.g. right ear canal. The hearing devices may have same or similar circuits, but differently shaped housings to fit in a left ear canal or a right ear canal.

The hearing devices 120; 121 comprises an acoustic input transducer 117; 128, e.g. a microphone, arranged in the hearing device at an opening of the ear canal. An acoustic output transducer 123; 126, e.g. a miniature loudspeaker, is arranged in the hearing device towards the eardrum. A gain stage 122; 127 is controlled via a controller 124; 129 that can communicate wirelessly with the electronic device 100. In some aspects, the gain stage 122; 127 is a part of a filter or equalizer e.g. a part of the flat insertion gain filter at least when the hearing device 120; 121 is engaged in a hear-through mode.

In some aspects, the gain stage 122; 127 is a gain stage without a filter, which is used during one or several of the sessions described herein. Since the first test signal is band-limited, the gain stage 122; 127 may be a gain stage without a filter.

FIG. 1*d* shows a block diagram of a pair of headphones. The pair of headphones 130 includes a first ear-cup 133 and a second ear-cup 134 each accommodating an acoustic output transducer 135: 136, e.g. a small loudspeaker. The pair of headphones includes a controller 131 which can communicate, e.g. wirelessly via antenna 132, with the electronic device 100. The pair of headphones also include a gain stage 137 for the acoustic output transducer 135 and a gain stage 138 for the acoustic output transducer 136. The gain stages 137 and 138 sets the loudness level communicated towards the user's ears. The gains of the gain stages 137; 138 can be controlled by the controller 131, which may include setting and getting respective gain values.

In some aspects, the gain stages 137; 138 are additionally or alternatively included in an application running on the electronic device or in circuitry of the electronic device 100.

Figure 2A:
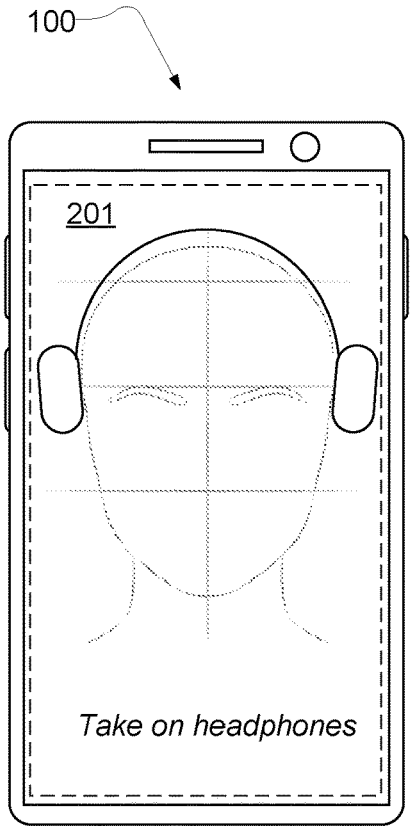
FIGS. 2*a* and 2*b* show examples of user interfaces for a first session.
Figure 2B:
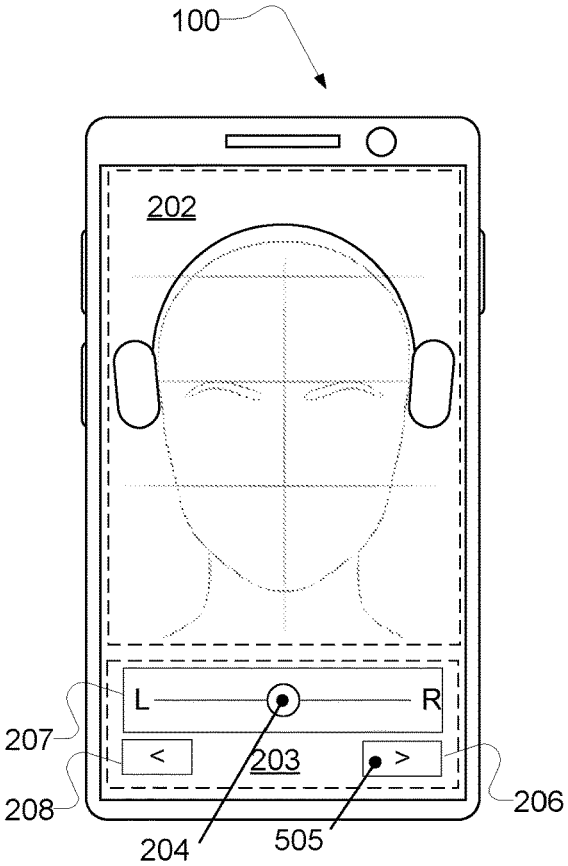

FIGS. 2*a* and 2*b* show examples of user interfaces for a first session. The electronic device 100 displays a user interface screen displaying a message 201 at a first time and a user interface screen displaying a message 202 at a second point in time. The user may give input to proceed from one user interface screen to another e.g. by a swipe gesture. The user interface screen also shows an affordance 207, in the form of a slider, and an affordance 203. The user may give his input 204 e.g. to move the slider. It is possible to get values from the slider for determining the third gain value. When the slider is at a rightmost position, it can correspond to a low value of the third gain value, whereas when the slider is at a leftmost position it can correspond to a high value of the first gain value.

The affordance 203 includes buttons 206 and 208 for advancing from one band-limited portion of the audio test signal to another band-limited portion of the audio test signal and/or for advancing from one session to another e.g. when a session has been completed e.g. when the user has given input for all band-limited portions of the audio test signal. The user may give his input 205 e.g. to advance to another band-limited portion of the audio test signal and/or to another session as mentioned above.

The messages, in any of the sessions, may be replaced by or accompanied by spoken audio instructions. The spoken audio instructions may be a human speaker's recorded voice or voice synthetically generated from text elements. The spoken audio instructions may be played back by a loudspeaker of the electronic device or played back by the pair of headphones.

Figure 3:
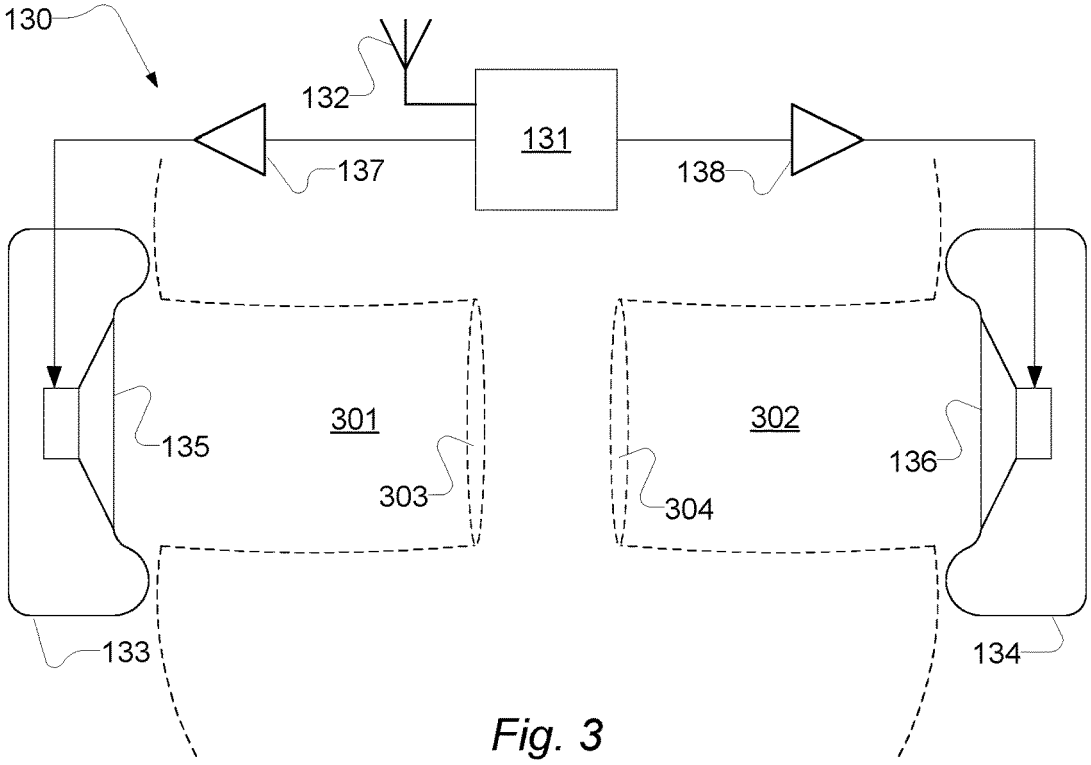
FIG. 3 shows a pair of headphones in position for the first session.

FIG. 3 shows a pair of headphones in position for the first session. The pair of headphones 130 is worn on the user's head and rests on or covers the user's ears, in particular the user's ear canals 301 and 302. The user's ear drums are designated by reference numerals 303 and 304.

Figure 4:
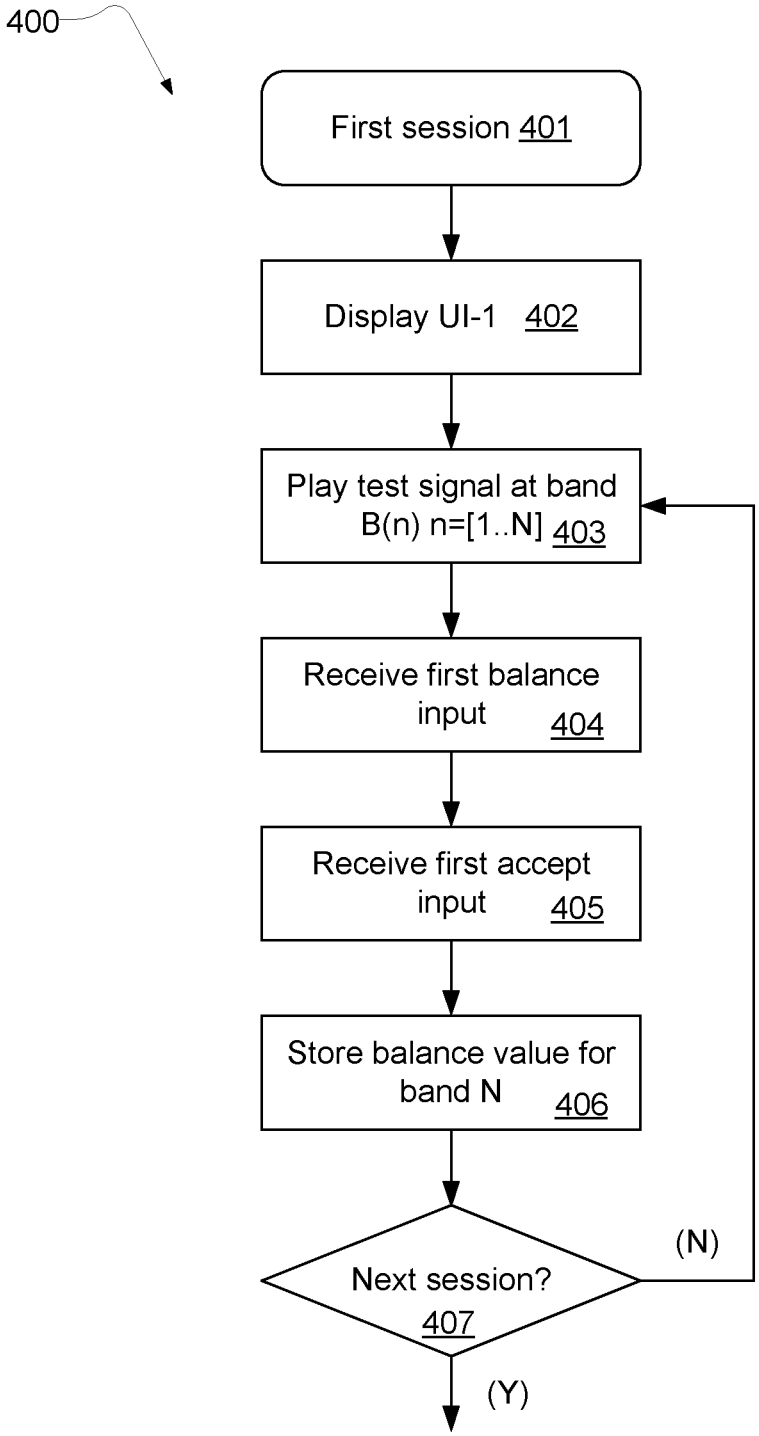
FIG. 4 shows a flowchart for the first session.

FIG. 4 shows a flowchart for the first session. At the first session, the method 400 starts at step 401 e.g. in response to a user tapping, on a touch-sensitive display of the electronic device, an affordance for activating an application. At step 402 a user interface screen, UI-1, e.g. including messages 201 and 202. Thereby the user is given instructions about what to do during the first session. At step 403 the audio test signal is communicated to the user via the headphones one band, B(n), at a time. A band-limited portion of the audio test signal is thereby communicated to the user. The method later reverts to step 403 to communicate another band-limited portion of the audio test signal to the user. The band-limited portions may be enumerated n=[1 . . . N] e.g. n=[1,2,3,4,5].

At step 404, a user's first balance input is received. The input may be given via a slider, e.g. slider 207, or another variable input e.g. a rotatable wheel. The gain values of the first gain stage and/or the second gain stage may be set in accordance with a value from the slider. Once the user is satisfied that the loudness is perceived as being equal at both ears, the user may give a first accept input e.g. via button 206 whereby the method proceeds to step 405 wherein the user's first accept input is received. The method then proceeds to step 406 to store the third gain value for band B(n). The method may then revert to step 403, via step 407 (N), and continue the method as described above for a next band-limited portion.

When all band-limited portions have been communicated to the user and the user has given the corresponding inputs, third gain values have been determined for all of the multiple bands. Then, the method determines at step 407 to proceed to a next session (Y).

Thereby, it is possible to obtain the first gain value and/or the second gain value (for multiple bands, e.g. one band at a time) based on communicating the first audio signal and/or the second audio signal via equalization; wherein the equalization is configured to change gain at a band in accordance with a gain value based on the third gain value for the band.

It is possible to forgo or skip the first session or to dispense with performing the method for the first session, e.g. if it is assumed that the user's hearing (loss) is symmetric between the left ear and the right ear.

Figures 5A, 5B, 5C:
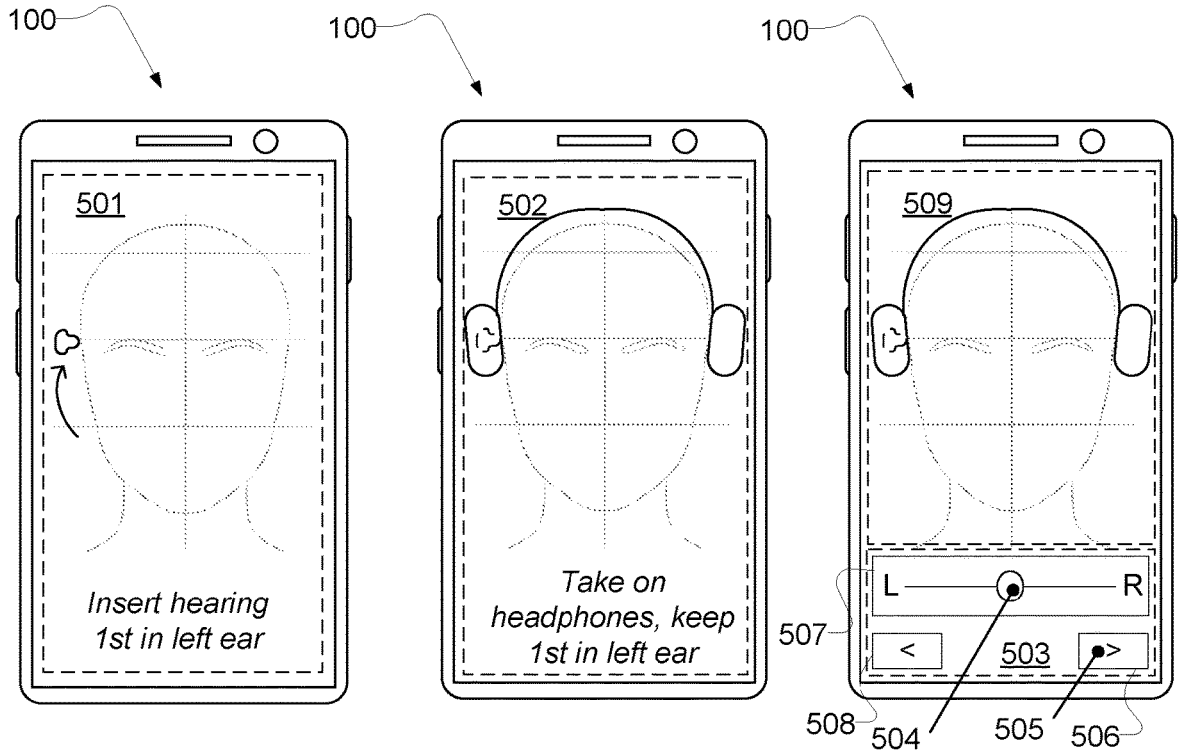
FIGS. 5*a*, 5*b* and 5*c* show examples of user interfaces for a second session.

FIGS. 5*a*, 5*b* and 5*c* show examples of user interfaces for a second session. The electronic device 100 displays a user interface screen displaying a message 501 at a first time and a user interface screen displaying a message 502 at a second point in time and a message 509 at a third time. The user may give input to proceed from one user interface screen to another e.g. by a swipe gesture. The user interface screen also shows an affordance 507, in the form of a slider, and an affordance 503. The user may give his input 504 e.g. to move the slider. It is possible to get values from the slider for determining the second gain value. When the slider is at a rightmost position, it can correspond to a low value of the second gain value, whereas when the slider is at a leftmost position it can correspond to a high value of the second gain value.

The affordance 503 includes buttons 506 and 208 for advancing from one band-limited portion of the audio test signal to another band-limited portion of the audio test signal and/or for advancing from one session to another e.g. when a session has been completed e.g. when the user has given input for all band-limited portions of the audio test signal. The user may give his input 505 e.g. to advance to another band-limited portion of the audio test signal and/or to another to another session as mentioned above.

Figure 6:
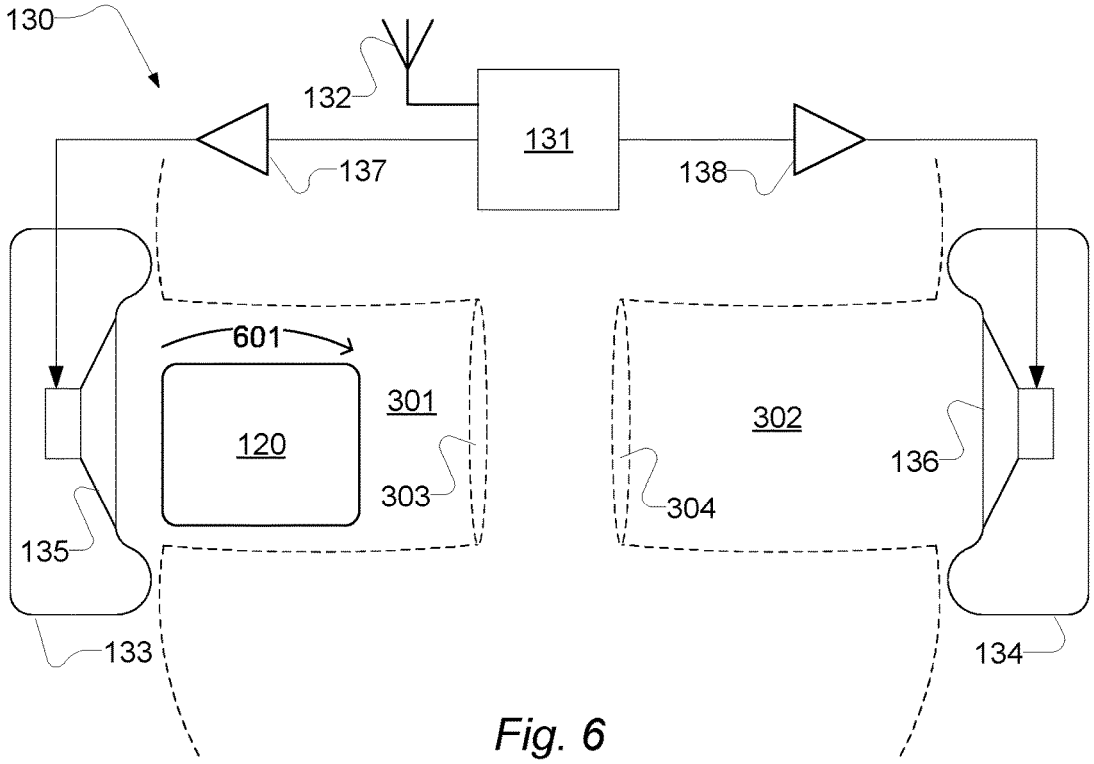
FIG. 6 shows a pair of headphones and a hearing device in position for the second session.

FIG. 6 shows a pair of headphones and a hearing device in position for the second session. The pair of headphones 130 is worn on the user's head and rests on or covers the user's ears, in particular the user's ear canals 301 and 302. The user's ear drums are designated by reference numerals 303 and 304.

Also shown is that the hearing device 120 is inserted in the left ear canal 301. Acoustic sounds from the surroundings passes the hearing device 120 as shown by arrow 601 which extends towards the eardrum 303 from an outer periphery of the ear canal 301.

Figure 7:
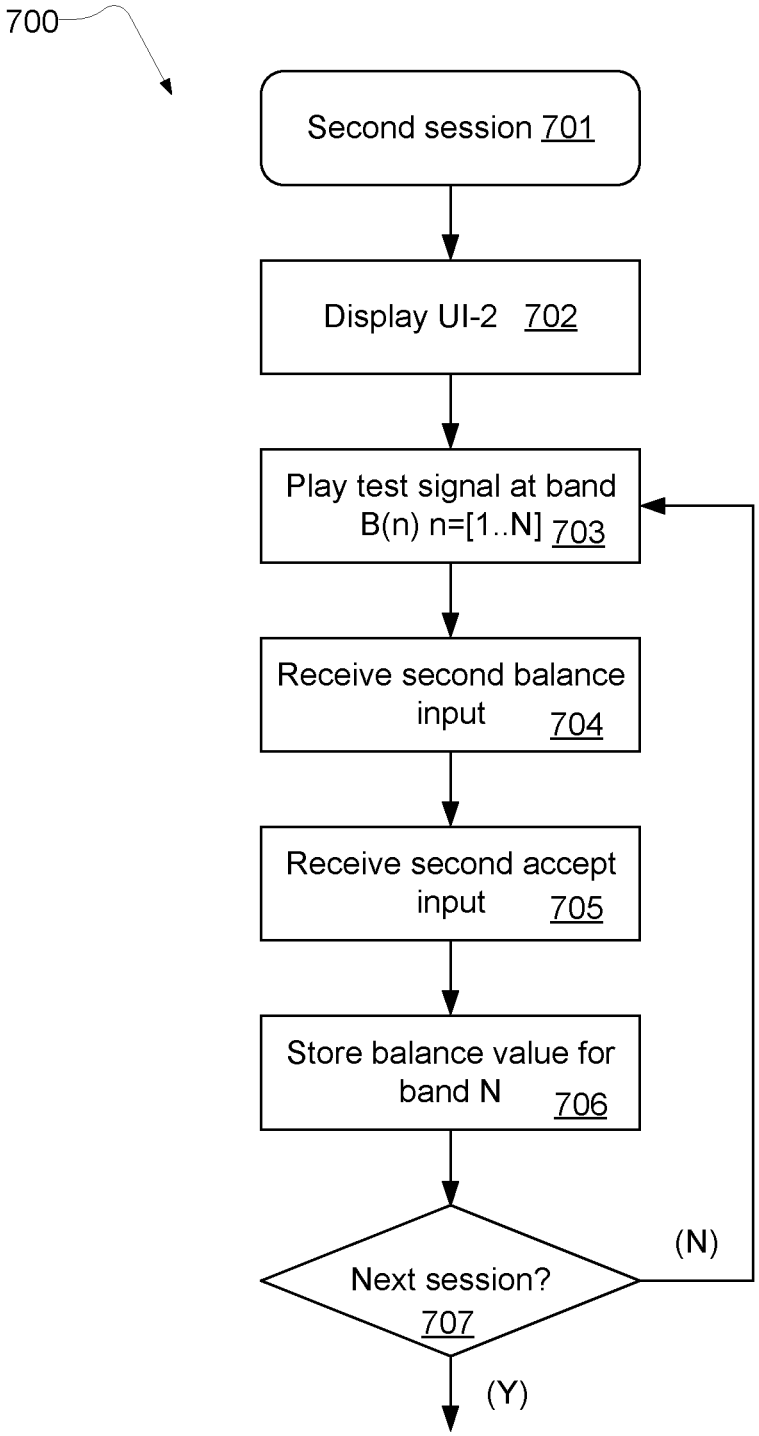
FIG. 7 shows a flowchart for the second session.

FIG. 7 shows a flowchart for the second session. At the second session, which may or may not follow the first session, the method 700 starts at step 701 e.g. in response to a user tapping, on a touch-sensitive display of the electronic device, an affordance for activating an application or in response to having completed the first session. At step 702 a user interface screen, UI-2, e.g. including messages 501, 502 and 509. Thereby the user is given instructions about what to do during the second session. At step 703 the audio test signal is communicated to the user via the headphones one band, B(n), at a time. The method later reverts to step 703 to communicate another band-limited portion of the audio test signal to the user. The band-limited portions may be enumerated n=[1 . . . N] e.g. n=[1,2,3,4,5].

At step 704, the user's second balance input is received. The input may be given via a slider, e.g. slider 507, or another variable input e.g. a rotatable wheel. The gain values of the first gain stage and/or the second gain stage may be set in accordance with a value from the slider. Once the user is satisfied that the loudness is perceived as being equal at both ears, the user may give a second accept input e.g. via button 506 whereby the method proceeds to step 705, where the user's second accept input is received. The method then proceeds to step 706 to store the first gain value for band B(n). The method may then revert to step 703, via step 707 (N), and continue the method as described above for a next band-limited portion.

When all band-limited portions have been communicated to the user and the user has given the corresponding inputs, first gain values have been determined for all of the multiple bands. Then, the method determines at step 707 to proceed to another session or to communicate to the user that the session or sessions is/are completed (Y).

Thereby, it is possible to obtain the first gain value and/or the second gain value (for multiple bands, e.g. one band at a time) e.g. based on third gain values obtained during the first session—or based on fixed third gain values obtained in another way than via the first session.

Figure 8A:
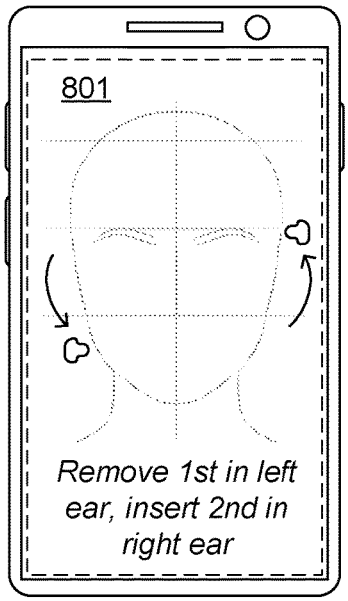
FIGS. 8*a*, 8*b* and 8*c* show examples of user interfaces for a third session.
Figure 8B:
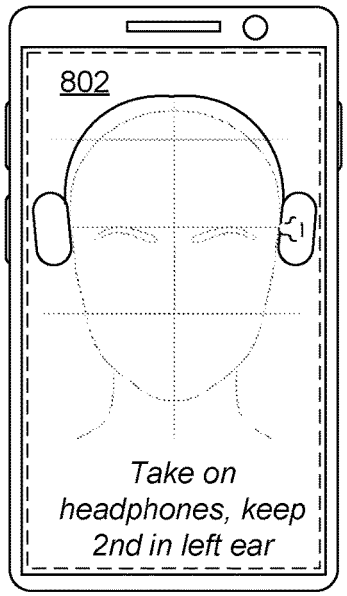
Figure 8C:
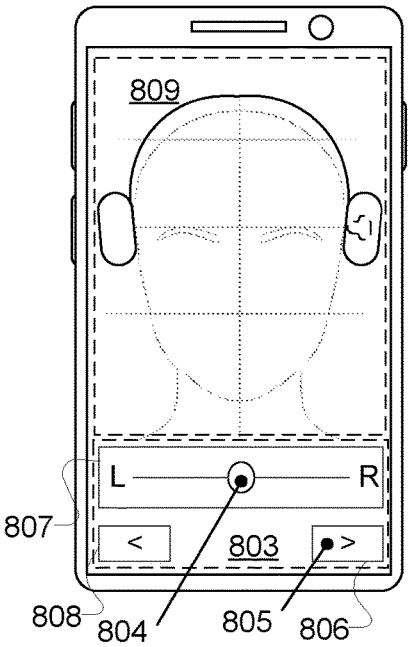

FIGS. 8*a*, 8*b* and 8*c* show examples of user interfaces for a third session. The electronic device 100 displays a user interface screen displaying a message 801 at a first time and a user interface screen displaying a message 802 at a second point in time and a message 809 at a third time. The user may give input to proceed from one user interface screen to another e.g. by a swipe gesture. The user interface screen also shows an affordance 807, in the form of a slider, and an affordance 803. The user may give his input 804 e.g. to move the slider. It is possible to get values from the slider for determining the second gain value. When the slider is at a rightmost position, it can correspond to a low value of the second gain value, whereas when the slider is at a leftmost position it can correspond to a high value of the second gain value.

The affordance 803 includes buttons 806 and 808 for advancing from one band-limited portion of the audio test signal to another band-limited portion of the audio test signal and/or for advancing from one session to another e.g. when a session has been completed e.g. when the user has given input for all band-limited portions of the audio test signal. The user may give his input 805 e.g. to advance as mentioned above.

Figure 9:
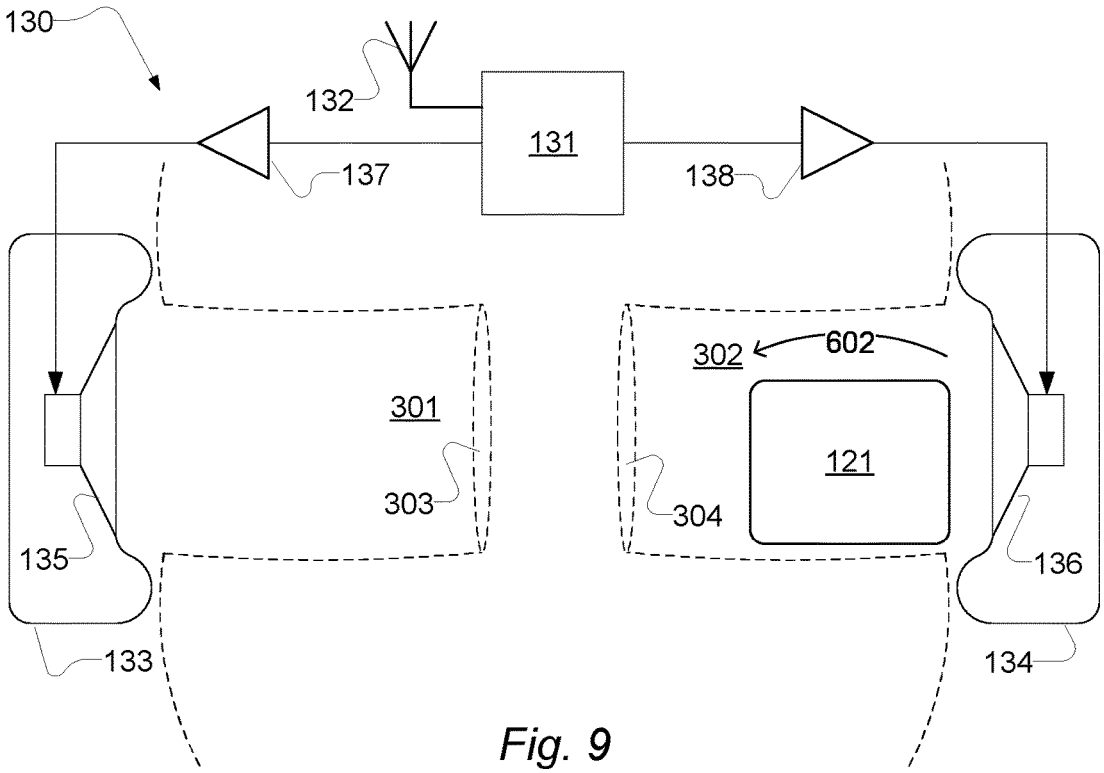
FIG. 9 shows a pair of headphones and a hearing device in position for the third session.

FIG. 9 shows a pair of headphones and a hearing device in position for the third session. The pair of headphones 130 is worn on the user's head and rests on or covers the user's ears, in particular the user's ear canals 301 and 302. The user's ear drums are designated by reference numerals 303 and 304.

Also shown is that the hearing device 121 is inserted in the right ear canal 302. Acoustic sounds from the surroundings passes the hearing device 121 as shown by arrow 602 which extends towards the eardrum 304 from an outer periphery of the ear canal 302.

Figure 10:
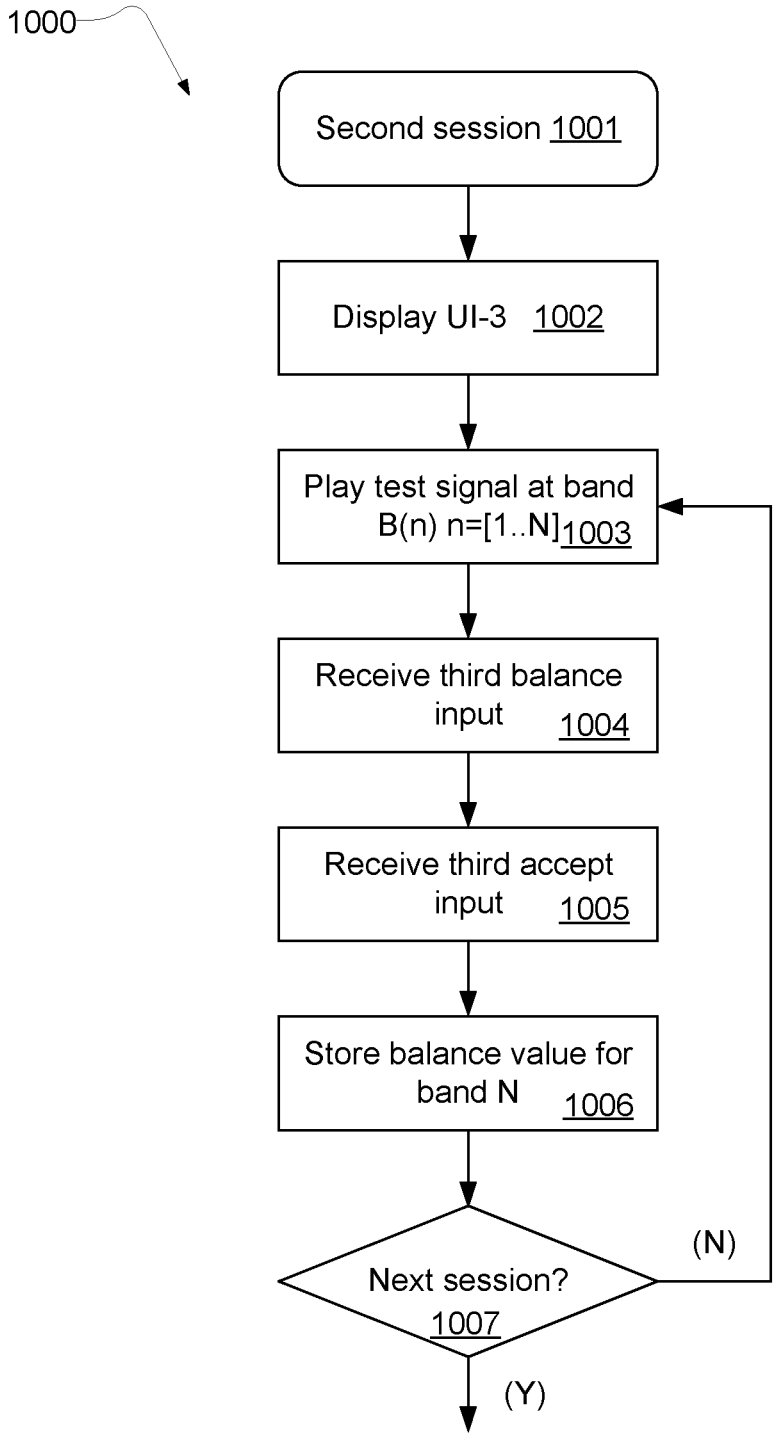
FIG. 10 shows a flowchart for the third session.

FIG. 10 shows a flowchart for the third session. At the third session, which may or may not follow the first session and/or the second session, the method 1000 starts at step 1001 e.g. in response to a user tapping, on a touch-sensitive display of the electronic device, an affordance for activating an application or in response to having completed the first session or second session. At step 1002 a user interface screen, UI-3, e.g. including messages 801, 802 and 809. Thereby the user is given instructions about what to do during the second session. At step 1003 the audio test signal is communicated to the user via the headphones one band, B(n), at a time. The method later reverts to step 1003 to communicate another band-limited portion of the audio test signal to the user. The band-limited portions may be enumerated n=[1 . . . N] e.g. n=[1,2,3,4,5].

At step 1004, the user's second balance input is received. The input may be given via a slider, e.g. slider 807, or another variable input e.g. a rotatable wheel. The gain values of the first gain stage and/or the second gain stage may be set in accordance with a value from the slider. Once the user is satisfied that the loudness is perceived as being equal at both ears, the user may give a second accept input e.g. via button 806 whereby the method proceeds to step 1005, where the user's third accept input is received. The method then proceeds to step 1006 to store the first gain value for band B(n). The method may then revert to step 1003, via step 1007 (N), and continue the method as described above for a next band-limited portion.

When all band-limited portions have been communicated to the user and the user has given the corresponding inputs, second gain values have been determined for all of the multiple bands. Then, the method determines at step 1007 to proceed to another session or to communicate to the user that the session or sessions is/are completed (Y).

Figure 11:
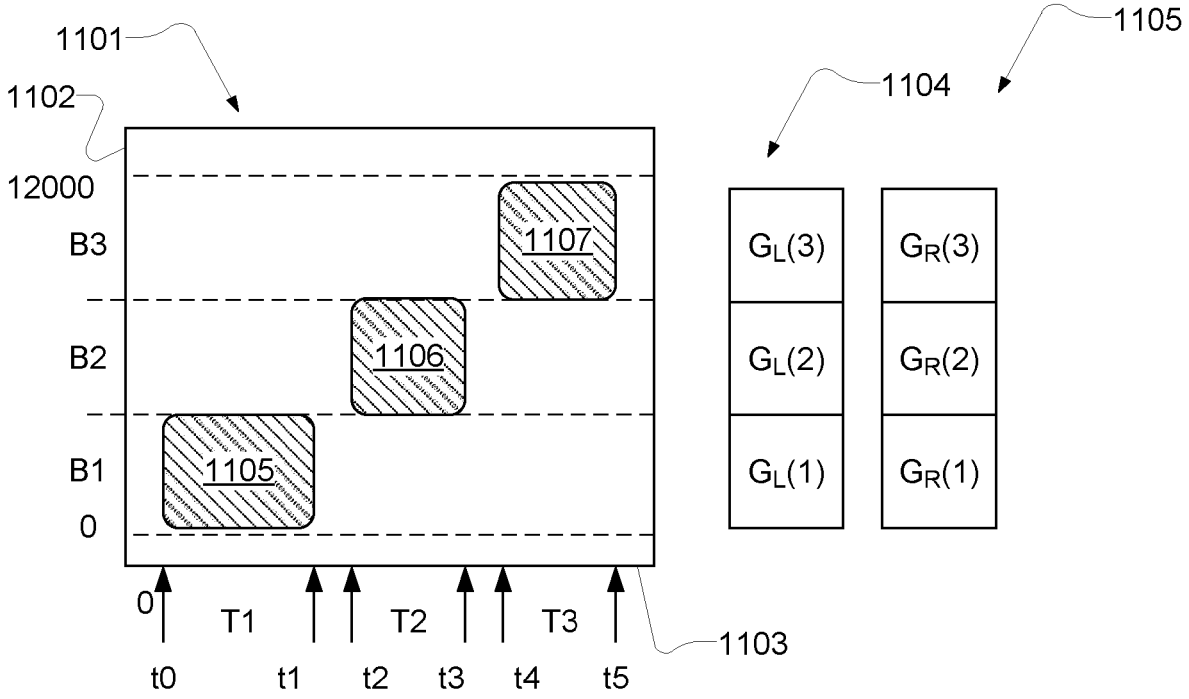
FIG. 11 shows a time-frequency chart for a test signal.

FIG. 11 shows a time-frequency chart for an audio test signal. The audio test signal is shown in a time-frequency chart 1101, wherein the abscissa 1103 represents time or time indexes and wherein the ordinate 1102 represents frequencies or frequency indexes. Along the ordinate is indicated three bands, enumerated B1, B2 and B3, respectively. The bands are shown as being non-overlapping bands in terms of frequency, but they may overlap at least to a certain degree. Along the abscissa is indicated points in time t0, t1, t2, t3, t4 and t5 and periods of time T1, T2 and T3. For instance, T1 runs from t0 to t1. The audio test signal is divided in band-limited portions 1105, 1106 and 1107. The hatched portions indicate amplitude levels which can be heard by an average person with normal hearing, whereas the white areas indicate amplitude levels which is much lower e.g. much below an audible level or at a noise floor.

The band-limited portions of the audio test signal are separated in time. The duration of time from one period, e.g. T1, to the next, e.g. T2, may depend on a user's response time and duration of a pause between the sessions. The duration of the band-limited portions depends on how long time the user takes to adjust and decide that loudness at both ears is the same or substantially the same. Generally, the more band-limited portions of the audio test signal, the longer it takes for a user to complete a session. In some aspects, the user is presented with the option to continue at additional bands, e.g. at additional, narrower bands or to stop. The option to stop can be given e.g. only after a predefined number of bands, e.g. three bands, have been presented.

The audio test signal may be distributed at frequencies between e.g. 20 Hz and 12 kHz or between e.g. 20 Hz and 20 kHz.

Also shown is an example of arrays 1104 and 1105 comprising first gain values $G_L(1)$, $G_L(2)$, and $G_L(3)$ and second gain values $G_R(1)$, $G_R(2)$, and $G_R(3)$. The gain values are associated with the respective bands B1, B2 and B3.

Figure 12:
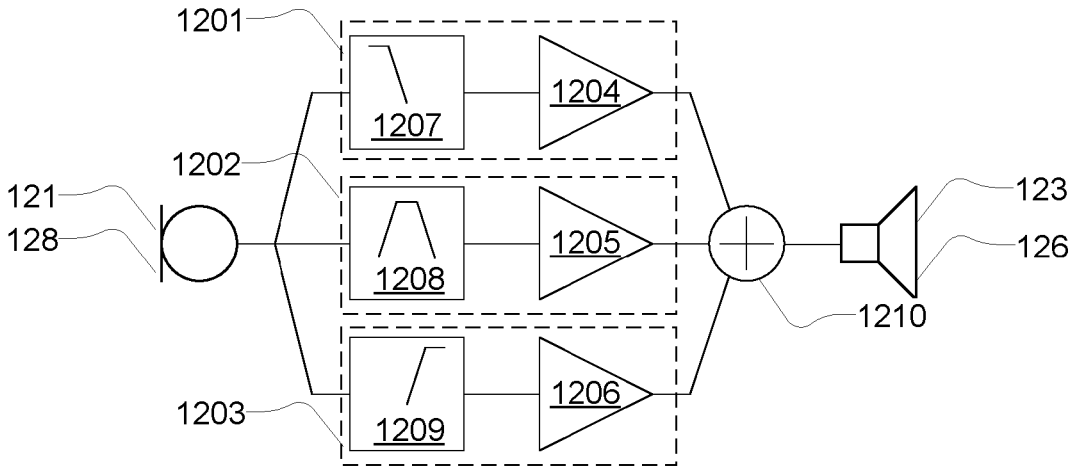
FIG. 12 shows a bank of gain filters for deploying flat insertion gain filters.

FIG. 12 shows a bank of gain filters for deploying flat insertion gain filters. The flat insertion gain filters are set to have a gain corresponding to the first gain values and second gain values e.g. from the arrays 1104 and 1105. The bank of gain filters may also be denoted a set of gain filters. The gain filters may be implemented as time-domain filters or as frequency-domain filters e.g. in a short-time frequency domain.

The gain filters 1201, 1202 and 1203 represents an example wherein three bands are used. Thus, there may be additional or fewer filters if additional or fewer bands are used. Each gain filter 1201, 1202 and 1203 comprises a filter section 1207, 1208 and 1309 and a respective gain stage 1204, 1205 and 1206.

A combiner 1210, e.g. an adder, combines outputs from the respective filters.

The bank of gain filters may implement the gain values determined in accordance with the method to enable deployment of flat insertion gain filters, or rather the gain values for the gain filters, at one or both of the first hearing device and the second hearing device.

Figure 13:
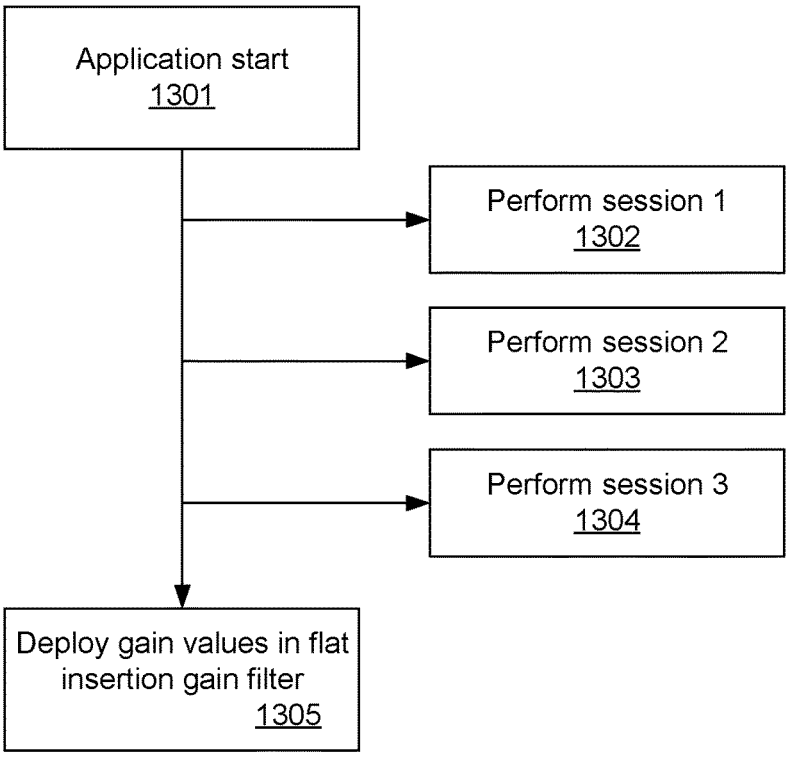
FIG. 13 shows a general flowchart for an embodiment of the method.

FIG. 13 shows a flowchart for an embodiment of the method. In step 1301 the application starts, and the user may connect to specific headphones and/or hearing devices for use during the sessions. Step 1301 may also include enabling first communication, to the pair of headphones 120 and enabling second communication to the first hearing device 120 and/or the second hearing device 121.

The methods 400, 700 and 1000 may be selectively performed at steps 1302, 1303 and 1304, respectively. Thus, the first session, the second session and the third session may be performed selectively e.g. depending on an assumption of symmetric hearing and/or whether gain values are to be obtained for one or a pair of hearing devices.

At step 1305, preferably when one or more of the sessions has/have been completed to obtain first gain values and/or second gain values and/or third gain values, the gain values can be deployed to one or more flat insertion gain filter(s) for or at a hearing device.

Figure 14:
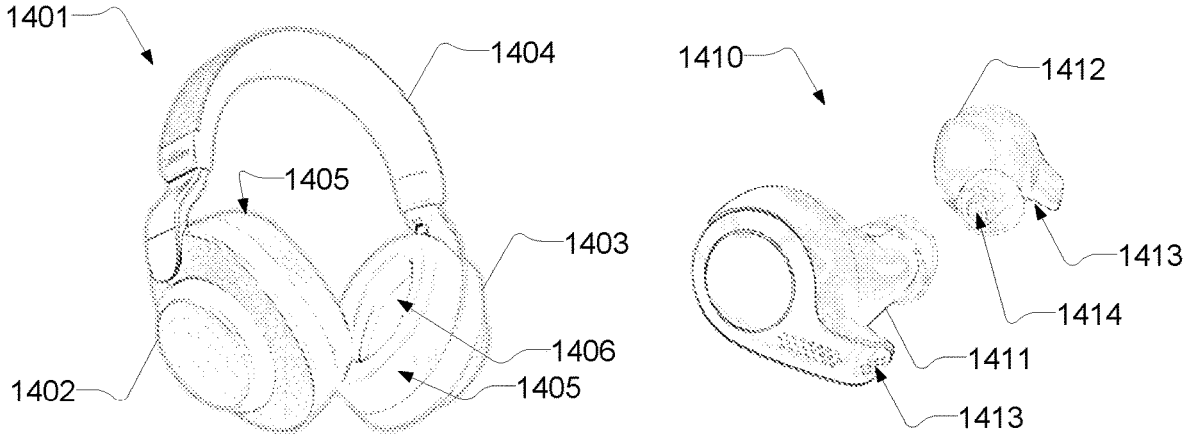
FIG. 14 shows embodiments of a pair of headphones and a pair of hearing devices.

FIG. 14 shows embodiments of a pair of headphones and a pair of hearing devices. The pair of headphones 1401 comprises a headband 1404 carrying a left ear-cup 1402 and a right ear-cup 1403 which may also be designated earpieces. The pair of hearing devices 1410, e.g. in the form of earphones comprises a left earpiece 1411 and a right earpiece 1412. The pair of headphones 1401 is an example of headphones 130. The hearing devices 1410 are examples of hearing devices 120; 121. The ear-cups 1402 and 1403 each comprises a cushion 1405 and an enclosed space 1406 established between the ear-cup and the user. The enclosed space is sufficiently large that the hearing devices 1411 and 1412 can be accommodated while the headphones are worn on the user's head and while the hearing devices 1411 and 1412 or one of them are/is inserted in the user's respective ear canals.

For the pair of hearing devices 1410, they each comprise a protrusion 1413 e.g. for accommodating an acoustic input transducer, e.g. one or more microphones. The acoustic output transducers of the hearing devices can emit sound through openings 1414 which face the user's eardrum, when inserted in the user's ear canal.

The term 'reproduced signal' refers to a signal which is presented to the user of the hearing device e.g. via a small loudspeaker, denoted a 'receiver' in the field of hearing devices. The 'reproduced signal' may include a compensation for a hearing loss or the 'reproduced signal' may be a signal with or without compensation for a hearing loss.

In some aspects, one or both of the hearing devices are configured to compensate for a hearing loss. In some aspects the electronic hearing device(s) is/are configured without compensation for a hearing loss. A hearing device may be configured to one or more of: protect against loud sound levels in the surroundings, playback of audio, communicate as a headset for telecommunication, and to compensate for a hearing loss.

Generally, a hearing device may also be designated a listening device.

The invention claimed is:

1. A method performed by an electronic device, comprising:

enabling first communication, via one or more communication elements of the electronic device, to a pair of headphones having a first acoustic output transducer and a second acoustic output transducer;

enabling second communication, via the one or more communication elements, to a first hearing device, wherein the first hearing device is configured for insertion in a first ear canal of a first ear of a user, and includes an acoustic input transducer coupled to an acoustic output transducer via a first gain stage, wherein the first ear is associated with a first eardrum;

communicating a band-limited portion of a first audio test signal via a second gain stage and via the first acoustic output transducer to the first hearing device while the first hearing device is in the first ear canal of the first ear and while the user wears one of the headphones, and communicating a band-limited portion of a second audio test signal via the second acoustic output transducer to a second eardrum of a second ear of the user while the user wears another one of the headphones without wearing a second hearing device at a second ear canal of the second ear of the user;

determining a first gain value based on a gain value of the first gain stage and/or a gain value of the second gain stage, wherein the first gain value is associated with the user's perception of equal loudness at both the first ear and the second ear of the user; and storing the first gain value.

2. The method according to claim 1, wherein the electronic device and/or the first hearing device is operatively coupled to the second hearing device, wherein the second hearing device is configured for insertion in the second ear canal of the second ear, and includes a third gain stage, and wherein the method further comprises:

communicating a band-limited portion of a third audio test signal via a fourth gain stage and via the second acoustic output transducer to the second hearing device while the second hearing device is in the second ear canal of the second ear and while the user wears the other one of the headphones, and communicating a band-limited portion of a fourth audio test signal via the first acoustic output transducer to the first eardrum of the user while the user wears the one of the headphone without wearing the first hearing device;

determining a second gain value based on a gain value of the third gain stage and/or a gain value of the fourth gain stage; and storing the second gain value.

3. The method according to claim 2, further comprising:

determining a third gain value; and storing the third gain value;

wherein an equalization for the first audio signal and/or the second audio signal is based on the third gain value.

4. The method according to claim 2, further comprising:

communicating, to the first hearing device, a first set of gain values, each based on the first gain value; and/or communicating, to the second hearing device, a second set of gain values, each based on the second gain value.

5. The method according to claim 2, further comprising:

determining whether to deploy the first gain value and/or the second gain value, and in accordance with a determination to deploy the first gain value and/or the second gain value:

deploying the first gain value at or for a set of gain filters at the first hearing device; and/or deploying the second gain value at or for a set of gain filters at the second hearing device.

6. The method according to claim 2, further comprising:

controlling the gain value of the first gain stage and/or the gain value of the second gain stage in response to a first input from the user during a session; and controlling the gain value of the third gain stage and/or a gain value of the fourth gain stage in response to a second input from the user during another session;

wherein the session and the other session do not overlap in time.

7. The method according to claim 6, further comprising determining a third gain value in response to a third input from the user, wherein the third gain value is determined during an addition session that precedes the session and the other session.

8. The method according to claim 1, further comprising displaying an affordance for receiving an input indicating the user's perception of the equal loudness;

wherein the first gain value is stored in response to receiving the input.

9. The method according to claim 1, further comprising communicating a first message, wherein the first message indicates that the headphones are to be worn while the first hearing device is to be inserted in the first ear of the user, and while the second hearing device is to be kept out of the second ear of the user.

10. The method according to claim 9, further comprising communicating a second message, wherein the second message indicates that the headphones are to be worn while the first hearing device is to be kept out of the first ear of the user, and while the second hearing device is to be inserted in the second ear of the user.

11. The method according to claim 10, further comprising communicating a third message, wherein the third message indicates that the headphones are to be worn while the first hearing device is to be kept out of the first ear of the user, and while the second hearing device is to be kept out of the second ear of the user.

12. The method according to claim 1, wherein the first hearing device comprises a first set of gain filters coupled between the acoustic input transducer and the acoustic output transducer of the first hearing device; and wherein the first set of gain filters is configured to change gain at a band in accordance with a gain value based on the first gain value.

13. The method according to claim 1, wherein the act of communicating the band-limited portion of the first audio test signal, the act of communicating the band- limited portion of the second audio test signal, and the act of determining the first gain value, are performed for each period of time of multiple periods of time.

14. The method according to claim 13, wherein, at each period of time of the multiple periods of time, the first audio is band-limited to a band associated with the corresponding period of time.

15. The method according to claim 13, wherein each period of time is associated with a band of multiple bands.

16. The method according to claim 1, further comprising:

displaying a first affordance for receiving a balance input from the user; and in response to receiving the balance input, adjusting the gain value of the first gain stage and/or the gain value of the second gain stage.

17. The method according to claim 1, wherein the first gain value and/or the second gain value are confined to a predefined increment and/or a predefined decrement and/or predefined gain levels.

18. The method according to claim 1, further comprising receiving a first input from the user, wherein the first gain value is determined in response to the first input.

19. The method according to claim 18, wherein the first input is received concurrently with the user wearing the first hearing device in the first ear and not wearing the second hearing device in the second ear.

20. The method according to claim 19, wherein the first hearing device and the second hearing device are included in a pair of hearing devices and are configured for wearing in or at the first ear of the user, and in or at the second ear of the user, respectively.

21. The method according to claim 19, further comprising receiving a second input from the user, wherein the second input is received concurrently with the user wearing the second hearing device in the second ear and not wearing the first hearing device in the first ear.

22. The method according to claim 21, further comprising receiving a third input from the user, wherein the third input is received concurrently with the user not wearing the first and second hearing devices.

23. The method according to claim 1, further comprising forgoing performing a fitting procedure to determine a possible hearing loss for the user.

24. The method according to claim 1, further comprising controlling the gain value of the first gain stage and/or the gain value of the second gain stage.

25. The method according to claim 1, wherein the first gain value is determined in response to a first input.

26. The method according to claim 1, wherein the first audio signal is communicated at different gain levels at different periods of time.

27. An electronic device, comprising:

one or more communication elements;

a display;

one or more input elements;

at least one processor coupled to the one or more communication elements, the display, and the one or more input elements; and a memory storing at least one program, wherein the at least one program is configured to be executed by the one or more processors, the at least one program including instructions for performing the method of claim 1.

28. A computer readable non-transitory storage medium comprising instructions, which when executed by at least one processor of an electronic device, will cause the electronic device to perform the method of claim 1.

* * * * *